United States Patent [19]

Snarr

[11] Patent Number: 4,620,700

[45] Date of Patent: Nov. 4, 1986

[54] OCCUPANT PROPELLED ROUNDABOUT

[76] Inventor: La Vere Snarr, 7071 S. 300 East, Midvale, Utah 84047

[21] Appl. No.: 703,188

[22] Filed: Feb. 19, 1985

[51] Int. Cl.[4] ..... A63G 1/12

[52] U.S. Cl. ..... 272/33 R; 272/51

[58] Field of Search ..... 272/33 R, 33 A, 33 B, 272/30, 50, 51, 39, 46, 1 R, 1 B, 37; 104/79, 80, 81

[56] References Cited

U.S. PATENT DOCUMENTS

| | | | |
|---|---|---|---|
| 1,612,970 | 1/1927 | Fisher | 272/51 |
| 1,712,703 | 5/1929 | Hudson | 272/33 A |
| 2,810,577 | 10/1957 | Howard | 272/33 R X |
| 2,841,395 | 7/1958 | Walker | 272/33 R |
| 3,073,595 | 1/1963 | Jones | 272/51 X |
| 3,439,914 | 4/1969 | Willard | 272/33 R |
| 3,462,140 | 8/1969 | Halaj | 272/33 R |
| 3,767,194 | 10/1973 | Barber | 272/51 |
| 3,837,641 | 9/1974 | Hanson et al. | 272/33 R |
| 4,369,969 | 1/1983 | Straub . | |

FOREIGN PATENT DOCUMENTS

| | | | |
|---|---|---|---|
| 2421474 | 11/1975 | Fed. Rep. of Germany | 272/33 R |
| 543921 | 6/1922 | France | 272/33 A |
| 568347 | 12/1923 | France | 272/33 A |
| 2288539 | 5/1976 | France | 272/33 R |
| 430714 | 6/1935 | United Kingdom | 272/51 |

*Primary Examiner*—Robert A. Hafer
*Assistant Examiner*—Arnold W. Kramer
*Attorney, Agent, or Firm*—Thorpe, North & Western

[57] ABSTRACT

An occupant propelled roundabout which includes a support base fixed to the ground in substantial upright orientation and having a rotatable hub attached at its upper end. This hub defines a rotational axis which is inclined with respect to a vertical reference. A support arm is attached to a rotating part of the hub and projects outward to attach at a platform provided to carry a user in sitting or standing position. The center of mass of the support arm and platform is offset from the rotational axis, which axis also intercepts a portion of the platform. The platform is attached in an acute inclined relationship with the rotational axis. An upstanding support member is attached at the platform and extends across the rotational axis. A gripping bar or seat member is positioned at the upper end of the upstanding support member to enable the user to partially counter balance against the weight of the platform during rotational motion. The gripping bar or seat may also include an upper platform to permit the user to sit therein, centering his weight near the rotational axis.

13 Claims, 2 Drawing Figures

OCCUPANT PROPELLED ROUNDABOUT

BACKGROUND OF THE INVENTION

1. Field of the Invention

This invention pertains to a rotating playground device such as a roundabout which includes a rotating platform which spins about a single axis and carries a seated or standing rider or riders. More particularly, it relates to an occupant propelled rotating platform in which the axis of rotation is inclined with respect to a vertical reference line.

2. Prior Art

Rotational platforms have long been popular as standard items of playground equipment. Typically, these devices are structured to service numerous riders at a single occasion. For example, U.S. Pat. No. 1,590,845 illustrates a merry-go-round adapted with benches at its perifery to enable a user to sit or stand while the device rotates. This particular device is inclined with respect to the vertical orientation (referred to herein as the vertical reference). This inclination permits the user to shift his weight and utilize the pull of gravity to rotate the platform A similar principle of operation is illustrated in U.S. Pat. No. 1,860,194.

In contrast U.S. Pat. No. 2,467,338 depicts a rotatable platform suited for use by one or two persons. It too is inclined with respect to the vertical reference to enable the user to rotate the device by shifting his weight and thereby displace the center of gravity and the platform to a new position. Each of these prior art devices share a common feature wherein the central axis of the rotating platform is coaxially alligned with the axis of rotation. Accordingly, the relative rotational movement of the platform with respect to the ground or other supporting surface remains substantially unchanged during use. For example, the inclination of the platform with respect to the ground stays approximately the same as the angle of inclination between the rotational axis and the vertical reference. Therefore, the ride offers little more than a tilted, conventional spinning platform. Furthermore the platform has the tilted appearance when at rest and provides no unexpected movement at the time of mounting.

OBJECTS AND SUMMARY OF THE INVENTION

It is therefore an object of the present invention to provide a rotational platform which provides relative vertical motion for the user with respect to the ground, as well as rotational motion.

It is a further object to provide a rotational device having a platform which rotates about the vertical reference at a variable inclination as it rotates around its rotational axis.

It is a still further object to provide a rotational platform which shifts from a level or near level position at rest to a radically displaced orientation at an inclined angle when the user places his weight on the platform.

These and other objects are realized in a rotational device which comprises a base support adapted for mounting in a fixed position at ground level or some other supporting surface. A rotatable axle or bearing is attached to the top of the support base and includes a projecting support arm which is attached at one end to the rotating part of the bearing and is attachable at its remaining end to a platform. The axis of rotation of the bearing is fixed in an inclined relationship with respect to the vertical reference. The platform is attached at the end of the support arm and is oriented so that the standing level is not normal to the axis of rotation. Instead it is inclined so that a person standing or sitting on the platform is inclined in relation to the axis of rotation. Where the platform is symmetrical, the central axis may be positioned at an acute angle with the rotational axis. The center of gravity of the platform may also be positioned off center of the axis of rotation so that the platform will gravitate to a lowest position when at rest. An upstanding support member is attached to the platform and includes means for the user to grip and shift weight to propel the device.

Other objects and features of the present invention will become more apparent to one skilled in the art in view of the following detailed description, taken with the accompanying drawings wherein.

DETAILED DESCRIPTION OF THE INVENTION

Figure 1:
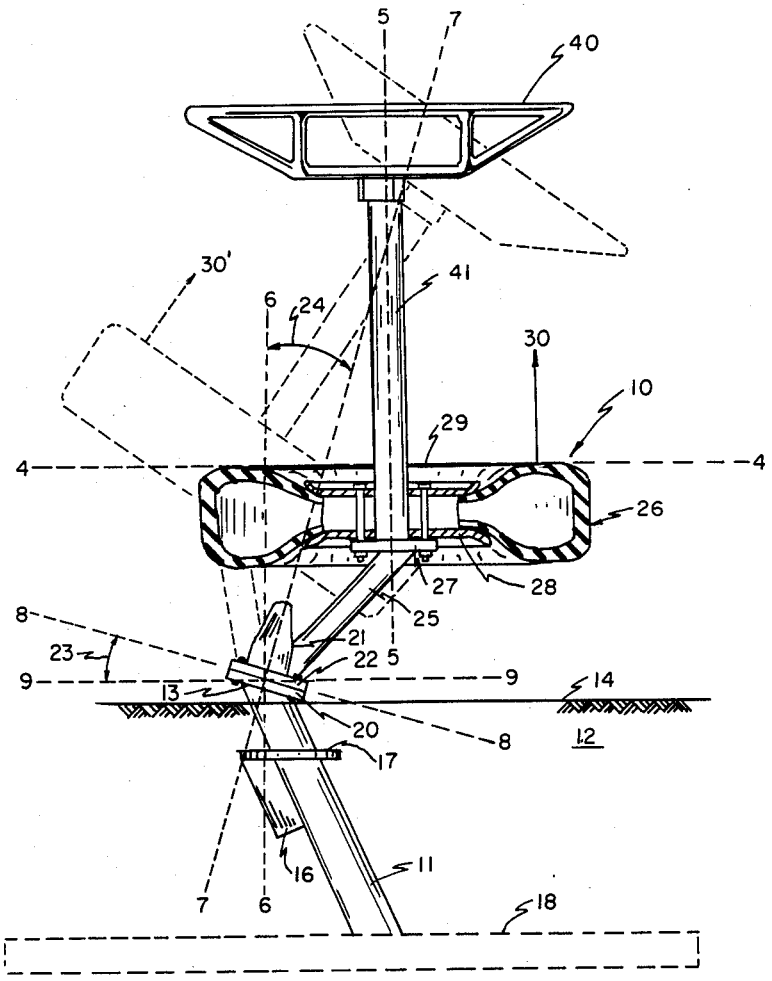
FIG. 1 shows a perspective view of one version of the present invention with the platform in cross-section along its diameter and in the low, at rest position, and also including a phantom line representation showing the opposing high platform position.

FIG. 1 illustrates a preferred embodiment of a rotational device 10 structured in accordance with the applicable inventive principles. The device comprises an upright base support or anchor 11 which provides a stable, fixed support for the attached rotating portion of the device. This base may consist of a steel pipe 11 buried in the ground 12 or cement with one upper end 13 projecting above ground level 14 to enable the device to rotate without being contacted or obstructed throughout the recurring 360 degrees of motion. The pipe configuration is restrained from angular movement by a projecting flange 16 or arm which locks the pipe in its fixed orientation. Similarly, a plate or annular disk 17 may be welded to the pipe to further stabilize the anchor against vertical movement.

Alternatively, the support base may comprise a heavily weighted base plate 18 which provides a degree of portability to the device. The phantom lined base plate 18 illustrates its attachment to the base anchor 11. If the subject device 10 utilized a base plate, the anchor would be much shorter and the plate would be resting on ground level 14. The radius of the plate should extend beyond the downward projection of the rotational path of the device 10 and must have sufficient mass to resist displacement by torsional force developed by the rotational movement described hereafter. It will be apparent that other base support structures are contemplated within the general principles of this disclosure.

In the disclosed embodiment, the top end 13 of the exposed base anchor is cut at an inclination with respect to its longitudinal axis to form a surface for a mounting plate 20 or first attachment means. This plate provides the structural support for attaching a bearing 21 or rotating hub means for enabling the desired rotational motion within the device. The illustrated bearing comprises an axle similar to that used with an automobile wheel assembly which can carry end thrust and radial loads. The fixed part 22 of the axle can be welded or bolted to the mounting plate. Because of the inclined orientation of the mounting plate defined by angle 23, the rotational axis 7 of the axle is likewise inclined with respect to the vertical reference 6 and forms angle 24. This inclined orientation is a necessary part of the subject invention because it allows the user to alternately shift his weight radially inward and outward to "pump" energy to the device during its recurring rotations.

The angle of inclination 24 between the axis of rotation 7 and the vertical reference 6 is technically unlimited; however, practically this inclination will fall between approximately 2 to 30 degrees to allow the rider to be comfortably positioned during use. The preferred range of inclination of the rotational axis for the disclosed embodiment is 5 to 15 degrees. The lower end of the range at 5 degrees provides a more gentle ride, while the 15 degree inclination is more agitated. It will be noted that the angle formed by the intersection of the rotational axis with the vertical reference is approximately the same as the angle of inclination 23 of the mounting plate with the level of the ground.

Although the axle bearing offers a suitable rotating means, other forms of bearings may be equally useful. Obviously, the bearing structure must be sturdy to bear the weight and torsional force developed. It must also be adapted for the rigid structural attachment that is required in coupling the bearing to the base support. It should also be noted that a mounting plate may be unnecessary where the fixed portion of the bearing and the top end of the support base are compatible in size and material for direct attachment by welding. The significant limitation for the rotating means is that an axis of rotation 7 is established as set forth above.

A second attachment means is provided to couple a rider platform 26 with the bearing 21. In the preferred embodiment, this attachment means comprises a tubular support arm 25 similar to the base anchor. This support arm is welded to the rotational portion of the bearing 21 to enable the arm to rotate around the bearing axis 7. The remaining end of the arm is attached to the platform. This is accomplished in the example shown in FIG. 1 with a second mounting plate 27 which is welded to the support arm 25. This plate is bolted to the base 28 of the platform.

The primary function of the second attachment means or support arm is to couple the platform 26 to the rotating means 21 such that the rider is positioned on the platform in an upright position 30 which is inclined with respect to and intercepted by the referenced rotational axis. Accordingly, the support arm in the example shown in FIG. 1 projects away from and is inclined with respect to the rotational axis 7 to shift the center of mass of the combined support arm and platform off center from the rotational axis. The resulting configuration can be expressed from several perspectives, based upon the nature or description of the platform. For example, the platform illustrated in FIGS. 1 and 2 comprises an automobile wheel structure 29 as shown in cross-section, or it could comprise a flat platform which provides a floor. The illustrated wheel embodiment has a circular configuration which is symmetrical about a central axis 5. As such, the platform has both (i) a central axis 5 and (ii) an upper platform surface or level 29 which falls within a common plane 4 and provides a suitable reference point to describe the inclined relationship between the platform generally and the rotational axis, referred to as the platform intersection angle. Specifically, an extension of the central axis 5 is to be in an inclined orientation with respect to the rotational axis of the bearing 7 so that a conical path is cut by the central axis as the platform rotates on its bearing. This can be similarly described wherein the common plane 4 of the platform intercepts the rotational axis 7 in a nonperpendicular orientation.

Obviously, such a configuration will require that the rider who assumes an upright position 30 with respect to the platform surface will be oriented toward the rotational axis 7 as opposed to being in parallel position. Several advantages develop with the inclination of the platform with respect to and having it off center from the rotational axis, where the rotational axis is already inclined with respect to the vertical reference. First, the platform assumes a low position (solid lines in FIG. 1) wherein the center of mass for the arm 25 and platform 26 is at its lowest point, based on the force of gravity. As the rider steps on almost any part of the left or right side of the platform, the center of mass shifts sideways and forces the platform to angularly displace. If the angles of inclination between (i) the central axis 5 of the platform and the rotational axis 7 and (ii) the rotational axis 7 and the vertical reference 6 are substantially equal, then the initial, rest position of the platform is nearly level with the ground. It is therefore likely to take the rider by surprize that his weight causes the platform to rotate toward a nonlevel position 30, merely be stepping on the platform.

The second novel aspect of this inclined relationship occurs as the rider shifts his weight in a recurring manner to develop greater rotational action. This rotational movement raises and lowers the level of the platform to create a combination of circular motion and vertical motion that provides more exhilaration to the rider. The exhilaration is further enhanced with increased speed. The degree of agitation provided by the ride is increased by enlarging the respective angles of inclination to increase the range of vertical motion. It will be apparent to one skilled in the art that the many variations of the location and angle of attachment will offer a variety of design options between a gentle ride appropriate for small children, to one that is more radical in movement for older children.

Figure 2:
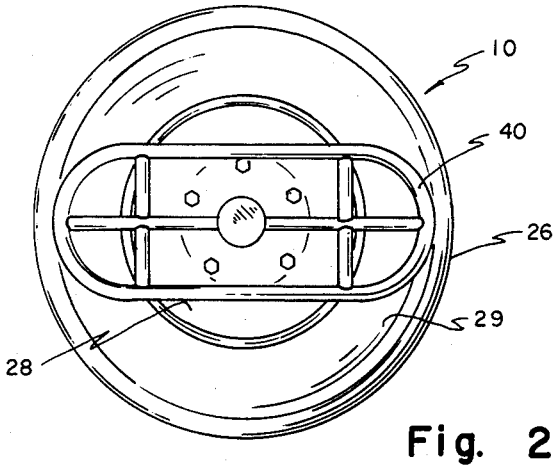
FIG. 2 depicts a top view of the device shown in FIG. 1.

As shown in FIGS. 1 and 2, a second seat or platform 40 can be positioned at a raised location above the first platform 26. This may be a basket shaped seat which is supported on an upstanding support member 41 such as a pipe. By orienting the upstanding support member along the central axis 5 of the platform or substantially perpendicular to the platform and by having the upstanding member extend across the rotational axis, the rotational movement of the second seat is similar to that of the first platform but has a lesser range of motion. The second seat should be in a position where its center of mass is off center from the rotational axis at 180 degrees or just opposite as to where the first platform is off center. The second seat should be off center about $\frac{1}{3}$ as much as the first platform. This tends to counterbalance the first platform. The figures show the second seat in a position which more nearly coincides with the rotational axis. This is not only a second seat but this second platform also provides a gripping means for those riding on the lower platform.

Dimensions for the device will vary depending upon the age of the user, as well as the projected number of concurrent users. The primary utility of this device, however, is that it is adapted for use by one rider, or several riders, when their movement is synchronized to pump energy into the rotational motion. Although additional lower platforms may be added, the preferred embodiment is two platforms as shown in FIG. 1 attached to a single bearing or hub. The lower platform as shown in FIG. 1 will generally have a width of less that five feet, and preferaably closer to three feet. The platform is positioned approximately one foot above ground level at its lowest position, with the support arm being less than two feet in length. The upstanding support arm is approximately two feet long and supports an oval basket seat about 16 by 30 inches. Except for the primary platform, the balance of the structure is made of steel pipe wherein the upstanding support pipe is approximately one and one half inches in diameter.

This device may be used as playground equipment or for home recreation. As the user mounts the device at almost any area, there is initial displacement in rotation. By shifting his weight inward and outward in a radial direction, the rotational movement can be increased. The rider soon learns to start, stop, speedup or reverse his rotation as he desires. Other variations of use will be apparent to those skilled in the art based upon the inclined relationships provided. It will be further apparent to those skilled in the art that numerous variations from the disclosed embodiments are possible without departing from the scope of the present invention. For example, a variety of seats and their location may be used or the symmetrical shape of the platform may be modified to a nonsymmetrical configuration to thereby offer a variation in the degree of rotational movement arising with the displacement of the rider's weight. It is therefore to be understood that the specific embodiments set forth herein are not to be construed as limiting the scope of the invention, except as provided in the following claims.

I claim:

1. A ground mounted, occupant propelled, roundabout device for developing rotational and oscillating vertical motion for a user, said device comprising:

a. a support base adapted for positioning substantially upright at a fixed location at the ground and having an upper end;

b. a rotatable hub means having a rotational axis and being attached to the upper end of the base such that the rotational axis is inclined with respect to a vertical reference;

c. a support arm attached to a rotating part of the hub means and projecting outward from the rotational axis;

d. a platform having a standing or sitting surface at an upper portion thereof and being attached to the support arm such that the center of mass of the support arm and platform is offset from the rotational axis and the body of the platform is intercepted thereby, said platform being inclined at the standing or sitting surface at an acute angle with respect to the rotational axis;

e. an upstanding support member attached at one end to the platform in substantial perpendicular orientation;

f. gripping means positioned at the upper end of the upstanding member and having a substantial portion of its structure on an opposing side of the rotational axis from the platform to enable the user to partially counter-balance user weight against the weight of the platform and to enable the user to shift weight to propel the roundabout in rotational motion.

2. A device as defined in claim 1, wherein the inclined rotational axis with respect to the vertical reference forms an angle within the range of 2 to 30 degrees.

3. A device as defined in claim 1, wherein the inclined rotational axis with respect to the vertical reference forms an angle within the range of 5 to 15 degrees.

4. A device as defined in claim 1, wherein the platform surface lies within a common plane, which plane is inclined with respect to the rotational axis.

5. A device as defined if claim 4, wherein the platform includes a central axis perpendicular to the plane and which intersects the rotational axis to form an axis intersection angle.

6. A device as defined in claim 5, wherein the support arm is coupled to the platform near the central axis.

7. A device as defined in claim 5, wherein the axis intersection angle is approximately equal to the angle defining the inclination between the vertical reference and the rotational axis.

8. A device as defined in claim 5, wherein the upstanding support member is positioned upright and along the central axis of the platform.

9. A device as defined in claim 1, wherein the gripping means further comprises a seat or small, second platform attached at the upper end of the upstanding support member which is adapted to support a user in a seated position during rotation of the platform.

10. A device as claimed in claim 9, wherein the second platform is intercepted by the rotational axis, positioning most of the second platform structure on an opposing side of the rotational axis from the first platform to provide a riding position which is less agitated in counterbalanced movement with respect to the first platform.

11. A device as defined in claim 9, wherein the second platform is substantially parallel with the first platform.

12. A device as defined in claim 1 wherein the support arm projects from the hub means in an upward, inclined orientation acute with respect to the rotational axis.

13. A device as defined in claim 1 wherein the platform surface is substantially horizontal at one aspect of rotation about the rotational axis, the platform surface being inclined during the balance of rotation.

* * * * *